United States Patent [19]

Ellison

[11] 4,079,813

[45] Mar. 21, 1978

[54] STEP-OUT WINDOW WASHER BOX

[75] Inventor: Clarence Ellison, Cincinnati, Ohio

[73] Assignee: The Raymond Lee Organization, Inc., New York, N.Y.

[21] Appl. No.: 700,977

[22] Filed: Jun. 29, 1976

[51] Int. Cl.[2] ..... A47L 3/02

[52] U.S. Cl. ..... 182/62

[58] Field of Search ..... 182/53, 54, 55, 56, 182/57, 58, 61, 62

[56] References Cited

U.S. PATENT DOCUMENTS

| | | | |
|---|---|---|---|
| 959,278 | 5/1910 | Wells | 182/54 |
| 1,423,998 | 7/1922 | Camp | 182/38 |
| 1,458,744 | 6/1923 | Brewster | 182/55 |
| 2,043,864 | 6/1936 | Novak | 182/55 |
| 2,059,739 | 11/1936 | Ment | 182/61 |
| 2,167,982 | 8/1939 | Kerber | 182/58 |

*Primary Examiner*—Reinaldo P. Machado
*Attorney, Agent, or Firm*—Howard I. Podell

[57] ABSTRACT

A collapsible structure which can be readily erected and supported outside of a window against an external building wall for use by a window washer, and can be withdrawn through the opening of the window after use. The structure is in the form of a rectangular box formed of frame members pivotably fastened to each other and fitted on each side, with a diagonal strut which is pinned in position to hold the structure open, and which bears against an external wall. A pair of horizontal struts extend from the erected box across the sill of a window and are each fitted with pivotal clamp arms to grip the inside structure wall under the window sill to hold the box in position for use.

1 Claim, 4 Drawing Figures

STEP-OUT WINDOW WASHER BOX

SUMMARY OF THE INVENTION

My invention is a collapsible structure which can be readily erected and supported outside of a window against an external building wall for use by a window washer, and can be withdrawn through the opening of the window after use. The structure is in the form of a rectangular box formed of frame members pivotably fastened to each other and fitted on each side, with a diagonal strut which is pinned in position to hold the structure open, and which bears against an external wall. A pair of horizontal struts extend from the erected box across the sill of a window and are each fitted with pivotal clamp arms to grip the inside structure wall under the window sill to hold the box in position for use.

By means of my invention a window washer may insert the unit, in the folded condition through an open window and erect it in place against the external and internal wall under the window sill, to provide an enclosed platform on which to stand, outside of the installed building below the level of a window to be washed. The device permits the window to be almost fully closed when in use.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
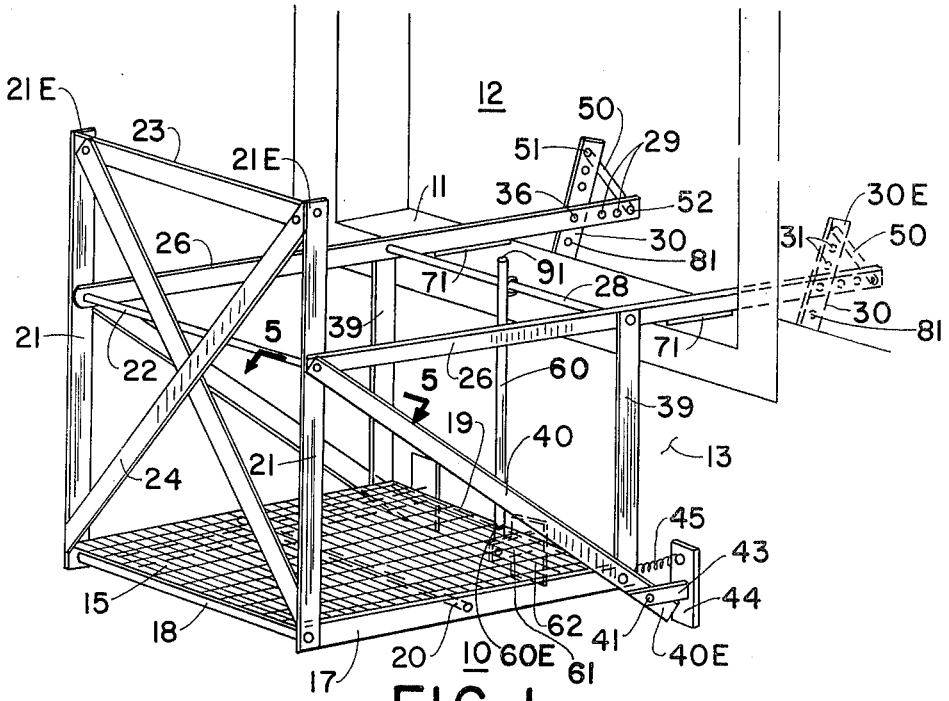
FIG. 1 is perspective view of the invention installed in the erect position.
Figure 3:
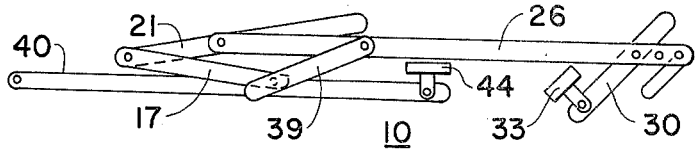
FIG. 3 is a side view of the invention in the folded position.
Figure 2:
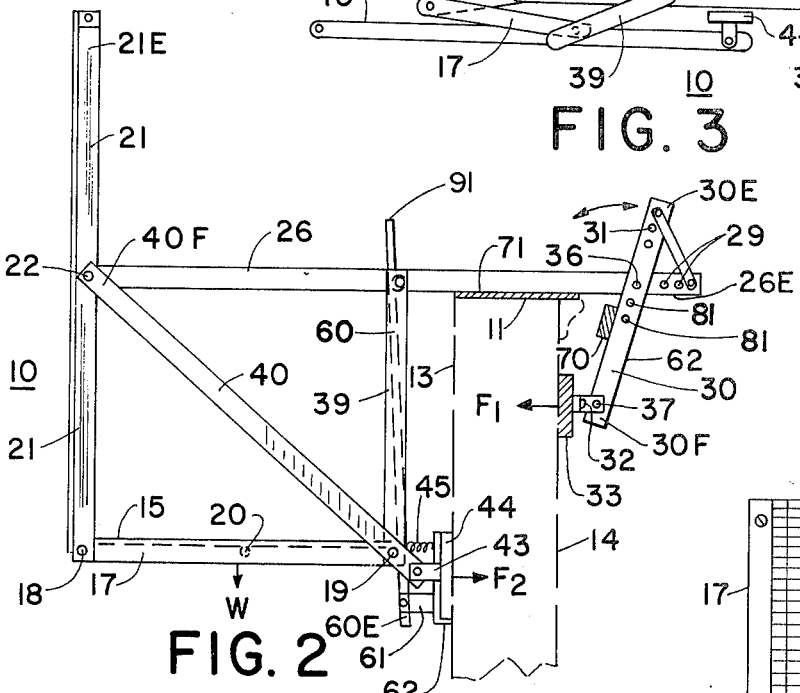
FIG. 2 is a side view of the invention installed in the erect position.
Figure 4:
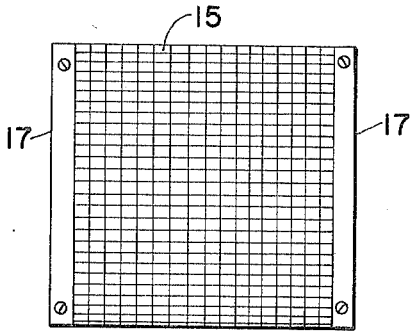
FIG. 4 is a bottom plan view of the platform.
Figure 5:
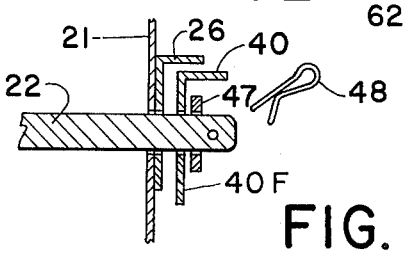
FIG. 5 is a detail sectional view taken along line 5—5 of FIG. 1.

Turning now descriptively to the drawings, in which similar reference characters denote similar elements throughout the several views, FIGS. 1–5 illustrate the invention in the form of a collapsible box 10 mounted across the sill 11 of a window opening 12 in a structure so as to be supported in cantilever fashion against the external wall 13 and the internal wall 14 of the structure.

The invention will be described, for purposes of clarity in the installed erect position.

Box 10 is fitted with a platform 15 formed of an open grid material fixed on each side to a bottom horizontal strut 17 in the form of an angle. Struts 17 are joined pivotally to horizontal lower rear rod 18, lower horizontal front rod 19, each respectively bordering platform 15, and fixed to intermediate horizontal rod 20.

Two parallel rear vertical bars 21 extend on each side of box 10 from lower rear rod 18 to which each is pivotally mounted, with both bars 21 extending vertically beyond, and supported pivotably by horizontal upper rear rod 22 and with the upper end 21E of each bar 21 fixed to an upper strut 23, joining both bars 21. Each bar 21 is fixed to the ends of a pair of diagonal braces 24 that are each fixed to an opposed bar 21 to form an X frame.

An upper horizontal strut 26 is mounted pivotally on each side of box 10 to upper rear rod 22, extending past forward upper rod 28, to which each is fixed and being fitted at the free end 26E with a plurality of spaced holes 29 located along the axis of strut 26. A clamp bar 30 is pivotally mounted adjacent a hole 29 by a bolt 36 through one of a plurality of holes 81 in bar 30 to each strut 26, with each clamp bar 30 formed with a plurality of axially spaced holes 31 at its upper end 30E and pivotally fixed by a rivet 37 to strut 32 at its lower end 30F to a clamp plate 33.

A forward vertical bar 39 is pivotally mounted on each side of box 10 to upper forward rod 28 and lower forward rod 19.

A side diagonal strut 40 is pivotally mounted on each side of box 10 to lower forward rod 19, each extending on both sides of rod 19, with the lower end 40E pivotally mounted by rivet 41 to a clamp strut 43 fixed to a clamp plate 44. Strut 43 may also be joined by a spring 45 to apply torsion to the joint of strut 43 and diagonal strut 40.

The upper end 40F of each diagonal strut 40 is detachably pivotally joined by washer 47 and cotter pin 48 to upper rear rod 22 in the erected position of box 10 to fix the box 10 in the open rectangular configuration.

One end of a link 50 is detachably pinned adjacent end 30E by pin 51 through a hole 31 to clamp bar 30 and the other end of link 50 detachably pinned by a pin 52 through a hole 29 in upper horizontal strut 26 to cause clamp plate 33 to bear against the surface of internal wall 14.

A jack bar 60 is pivotally mounted to upper forward bar 28 with a handle section 91 extending above bar 28 and with the lower end 60E of bar 60 pivotally mounted to a strut 61 fixed to a plate 62. Bar 60 may be rotatably joined to lower forward bar 19 or freely extend forward of bar 19 between bar 19 and exterior wall 13.

Jack bar 60 serves as a lever arm to rotate the box 10, when diagonal braces 40 are detached from upper rear rod 22 to the folded or unfolded condition when erecting or collapsing the box 10.

Resilient bumpers 70 may be installed on clamp arm 30 and similar bumpers 71 may be installed on struts 26 to protect the window sill 11 from being damaged, and clamp plates 44, 33 and 62 may be similarly formed of resilient material to avoid marring of external or internal wall surfaces and to provide frictional engagement, when installed.

The plurality of holes 31 and 29 provide adjustment means to vary the angle between each clamp bar 30 and attached horizontal strut 26 so as to provide adjustment for clamping plates 33 and 44 to walls of varying thickness.

The length of the lever arm 62 of clamp bar 30 between bolt 36 and clamp plate 33 may be adjusted by choice of pivot hole 81 so that the equal forces $F_1$ and $F_2$ may be varied to balance the load force W of the erected box 10 and its work load by varying the length of the arm 62 of clamp bar 30 between bolt 36 and plate 33, lever arm 62 maintained less than the vertical distance between clamp plate 44 and strut 26. Forces $F_1$ and $F_2$ may be sufficient to generate vertical frictional components of a magnitude to support the erected structure without necessitating vertical support from sill 11 against strut 26, if desired, with proper location of bolt 36 for a given thickness distance between the surfaces of internal wall 14 and external wall 13.

While the pivotal joints linking the members have not been described in detail, they may be held in place by conventional fastening means such as pins, rivets, bolts, with suitable detents or other spacing fasteners to assure uniform spacing of the joined side members from each other.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A collapsible frame fitted with means to mount about the interior and exterior surfaces of a vertical wall supporting a window sill bounding a window opening in said wall so as to extend beyond the exterior of the said wall, said frame formed with a first pair of clamp plates pivotally mounted to the frame and located to bear against an interior surface of a vertical wall a second pair of clamp plates pivotally mounted to the frame and located to bear against the exterior surface of said vertical walls, said clamp plates joined by a pair of support members located so as to extend above both pairs of clamp plates and over a window sill of a window opening in said vertical wall, in the erect position of the frame, in which the first pair of clamp plates are each pivotally mounted to an individual bar, with each bar pivotally mounted to a separate support member so as to extend on both sides of the support member, by a pin through one of a first plurality of holes in the said bar, with the said bar formed with a second plurality of holes in the end section of the bar that is opposed to the clamp plates, together with a bracket individually pivotally mounted to each support member and mounted by a pin into one of the second plurality of holes of the bar so that the clamp plate may be positioned by the bar to the support member by a distance sufficient for the clamp plate and bar to clear an extension of the window sill that projects internally over the interior surface of the mounted vertical wall, in which the frame is formed of a structure which forms an open box in the erect position, and in which a rod is pivotally mounted to the box unit structure of the frame, said rod joined to the frame so as to be rotatable, when members of the frame are rotated from a first collapsed position to a second erect position, with said rod pivotally mounted to a horizontal section of the box unit that extends parallel to the plane of the window sill when the unit is installed and with said rod located between the support members attached to the first and second clamp plates, with said rod extending in the vertical direction when installed so as to extend below the box unit adjacent to the exterior surface of the wall and to extend above the said horizontal section, such that manual rotation of the top section of the bar above the said horizontal section in the installed position causes the lower section of the bar to bear against the lower section of the box unit to rotate the box unit upwards and into the window opening of the wall for purposes of removal of the unit from an attached wall.

* * * * *